US009428251B2

(12) United States Patent
Ryu et al.

(10) Patent No.: US 9,428,251 B2
(45) Date of Patent: Aug. 30, 2016

(54) MOORING LINE EXTENSION SYSTEM

(71) Applicant: EXXON-MOBIL UPSTREAM RESEARCH COMPANY, Houston, TX (US)

(72) Inventors: Sangsoo Ryu, Cypress, TX (US); Craig B. Martin, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/387,194

(22) PCT Filed: Apr. 2, 2013

(86) PCT No.: PCT/US2013/034994
§ 371 (c)(1),
(2) Date: Sep. 22, 2014

(87) PCT Pub. No.: WO2013/165641
PCT Pub. Date: Nov. 7, 2013

(65) Prior Publication Data

US 2015/0047544 A1 Feb. 19, 2015

Related U.S. Application Data

(60) Provisional application No. 61/641,062, filed on May 1, 2012.

(51) Int. Cl.
*B63B 21/00* (2006.01)
*B63B 21/46* (2006.01)
(Continued)

(52) U.S. Cl.
CPC ..... *B63B 21/46* (2013.01); *B63B 21/00* (2013.01); *B63B 21/20* (2013.01); *B63B 35/44* (2013.01); *B63B 21/50* (2013.01)

(58) Field of Classification Search
CPC ..... B63B 21/00; B63B 21/04; B63B 21/20; B63B 21/46; B63B 35/44; B63B 2021/20; B63B 2021/00
USPC ..... 114/230.2, 230.25, 230.26, 220.29
See application file for complete search history.

(56) References Cited

U.S. PATENT DOCUMENTS 2,980,050 A * 4/1961 Murray ..... B63B 21/243 114/298
4,798,159 A 1/1989 Taylor et al.
(Continued)

OTHER PUBLICATIONS

Brown, M.G. et al, "Floating Production Mooring Integrity JIP—Key Findings", OTC 17499, May 2-5, 2005, Offshore Technology Conference, Houston, TX.
(Continued)

*Primary Examiner* — Daniel V Venne
(74) *Attorney, Agent, or Firm* — ExxonMobil Upstream Research Company Law Dept.

(57) ABSTRACT

A mooring system for a marine vessel utilizing an extension system. The mooring system comprises at least one mooring line having a first line section and a second line section. An extension device is associated with the at least one mooring line. The extension device has a first component and a second component. The first and second component each has a shear pin hole. A shear pin is positioned within the shear pin holes thereby connecting the first component and the second component. The mooring system also comprises an extension line having a first end connected to the first component and a second end connected to the second component.

12 Claims, 4 Drawing Sheets

(51) Int. Cl.

| | |
|---|---|
| ***B63B 21/20*** | (2006.01) |
| ***B63B 35/44*** | (2006.01) |
| *B63B 21/50* | (2006.01) |

(56) References Cited

U.S. PATENT DOCUMENTS

| | | | | |
|---|---|---|---|---|
| 4,836,126 | A * | 6/1989 | Kobayashi | B63B 21/46 114/297 |
| 5,074,235 | A | 12/1991 | Kobayashi | |
| 5,337,693 | A | 8/1994 | Ross et al. | |
| 5,944,448 | A | 8/1999 | Williams | |
| 6,209,475 | B1 | 4/2001 | Powell | |
| 6,240,870 | B1 | 6/2001 | Komura et al. | |
| 6,951,183 | B1 * | 10/2005 | Burback | B63B 21/243 114/297 |
| 7,886,681 | B2 * | 2/2011 | Weinstein | B63B 21/46 114/299 |
| 8,485,117 | B2 * | 7/2013 | Weinstein | B63B 21/46 114/299 |
| 2009/0266287 | A1 | 10/2009 | Neidermair | |
| 2010/0326344 | A1 | 12/2010 | Weinstein et al. | |

OTHER PUBLICATIONS

Muncer, M., "Analysis of accident statistics for floating monohull and fixed installations", 2003, Health and Safety Executive, HSE esearch Report 047, 25 pages, Aberdeen, UK.

Vryhof Anchors, B.V., Stevmanta VLA (Vertical Load Anchor), Feb. 2, 2012, 2 pages http://www.vryhof.com/products/anchors/stevmanta_vla.html.

Dynamic Load Monitoring, Jul. 11, 2010, 1 page http://www.dlm-uk.com/.

Dynamic Load Monitoring, Apr. 17, 2011, 2 pages http://www.dlm-uk.com/.

* cited by examiner

MOORING LINE EXTENSION SYSTEM

CROSS-REFERENCE TO RELATED APPLICATION

This application is the National Stage of International Application No. PCT/US2013/034994, filed 2 Apr. 2013, which claims the priority benefit of U.S. Provisional Patent Application 61/641,062, filed 1 May 2012 entitled MOORING LINE EXTENSION SYSTEM, the entirety of which is incorporated by reference herein.

FIELD OF INVENTION

This invention generally relates to the field of permanent mooring systems for marine vessels and, more particularly, to a mooring line extension system to prevent failure of permanent mooring systems.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Mooring line failure of an offshore permanent floating structure can result in financial consequences and physical damage, particularly in oil/gas fields. Significant financial damages due to a mooring system failure may result from high cost of repair or replacement of the damaged mooring line, production shut-down, and/or long lead procurement of the new mooring component. Mooring failure records show that production semis have a failure every 9 years and every 8.8 years for FPSOs (Floating, Production, Storage, and Offloading). See M. G. Brown et al., "Floating Production Mooring Integrity JIP—Key Findings", OTC 17499 (2005); "Analysis of Accident Statistics for Floating Monohull and Fixed Installations", HSE Research Report 047 (2003). Challenges in repair or replacement of broken mooring lines include spare line costs, project dependency of sizes and configurations of mooring, maintenance challenges, and long lead time for procurement of new mooring line components.

A conventional permanent mooring line system is depicted in FIG. 1. As vessel 101 floats in the water 103, it is held in place by the combination of mooring line 105 and anchor 107. Mooring line 105 is fixed to vessel 101 and anchor 107. Anchors 107 are held in place by being driven into the seabed 109. As a load is placed upon vessel 101, the tension within the mooring lines 105 increases. Once the tension passes the threshold the mooring line can withstand, mooring line 105 will break thereby creating an unsafe condition for vessel 101 and the surrounding equipment, which may include, but is not limited to, risers/umbilicals, subsea pipeline and equipment, and other oil/gas production equipment.

In the case of a mooring line bundle, when a plurality of mooring lines is fixed to the vessel, one of the lines within the bundle is typically subjected to the greatest load. When the tension exceeds the threshold for that line, the mooring line will fail (i.e., break). Naturally, the loss of one mooring line causes an increase in tension within the other mooring lines of that bundle. Unless the load on the vessel is reduced, there is a significant likelihood that the loss of one mooring line will result in the failure of the other lines within the bundle, inevitably leading to undesirable consequences: financial, safety, or otherwise.

Presently, there is no mechanism to prevent failure of a mooring line 105 due to the vessel 101 being driven by the extreme load such as, but not limited to, squalls, icebergs, and hurricane. Although permanent mooring systems of offshore floating structures are designed and installed with design margin, there has been a growing concern about the safety factor of the mooring system which may not be able to meet industry standard requirements due to: (a) metocean criteria update, (b) expansion of the existing project, and (c) uncertainty of "actual" extreme loads (e.g., squall, icebergs, hurricane, etc.).

Thus, there is a need for improvement in this field.

SUMMARY OF THE INVENTION

The present invention provides a mooring line extension system.

One embodiment of the present disclosure is a mooring system for a marine vessel comprising: at least one mooring line, each of the at least one mooring lines having a first line section and a second line section; an extension device associated with the at least one mooring lines, the extension devices comprises a first component and a second component, the first component having a first shear pin hole, the second component having a second shear pin hole; a shear pin positioned within the first shear pin hole and the second shear pin hole thereby connecting the first component and the second component; and an extension line having a first end connected to the first component and a second end connected to the second component.

The foregoing has broadly outlined the features of one embodiment of the present disclosure in order that the detailed description that follows may be better understood. Additional features and embodiments will also be described herein.

BRIEF DESCRIPTION OF THE DRAWINGS

The present invention and its advantages will be better understood by referring to the following detailed description and the attached drawings.

Figure 1:
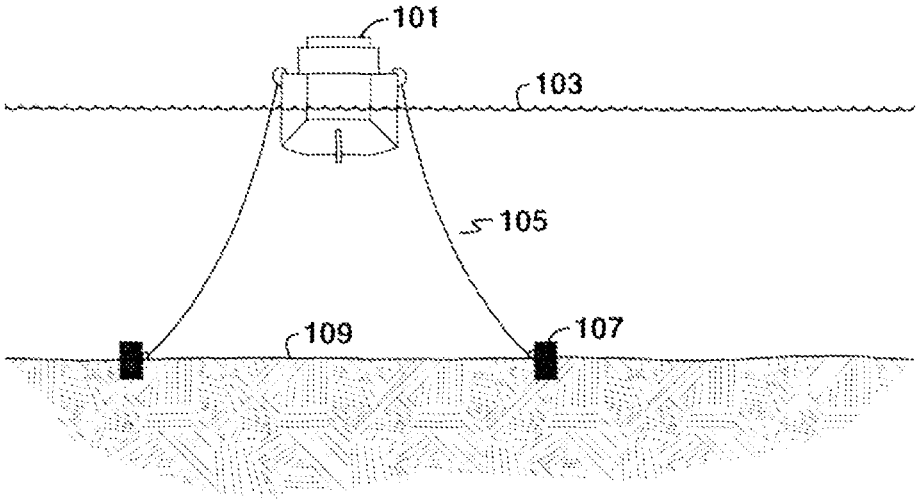
FIG. 1 Prior Art
FIG. 1 is a side view of a permanent mooring system as presently known in the prior art.

It should be noted that the figures are merely examples of several embodiments of the present invention and no limitations on the scope of the present invention are intended thereby. Further, the figures are generally not drawn to scale, but are drafted for purposes of convenience and clarity in illustrating various aspects of certain embodiments of the invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. At least one embodiment of the invention is shown in great detail, although it will be apparent to those skilled in the relevant art that some features that are not relevant to the present invention may not be shown for the sake of clarity.

Figure 2:
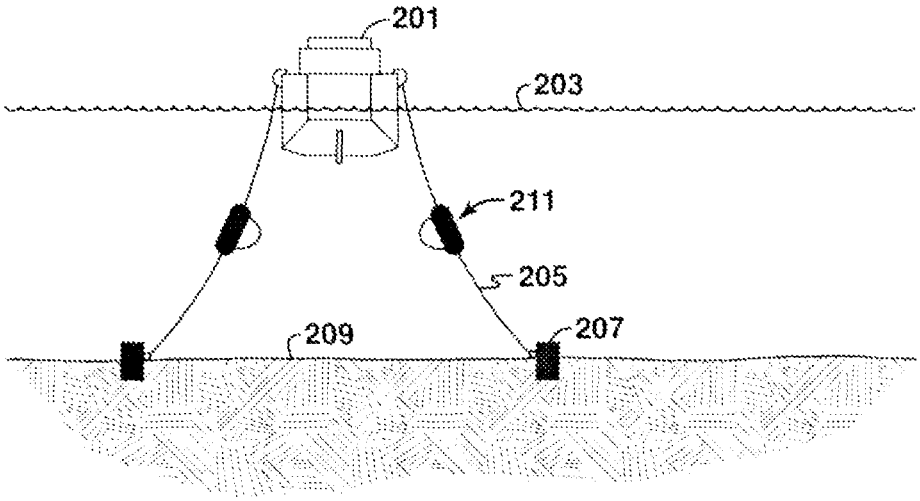
FIG. 2 is a side view of a permanent mooring system according to one embodiment of the present disclosure.

A permanent mooring line system according to one embodiment of the present disclosure is depicted in FIG. 2. The permanent mooring system depicted in FIG. 2 contains many of the components depicted in FIG. 1. Vessel 201 floats in the water 203 and is held in place by the combination of at least one mooring line 205 and anchor 207. Mooring line 205 is fixed to vessel 201 and anchor 207. Anchors 207 are held in place by being driven into the seabed 209 by known techniques.

Unlike the system depicted in FIG. 1, the FIG. 2 system includes extension system 211 on mooring line 205. In embodiments in which a mooring line bundle is incorporated, an extension system may be provided on each line within the bundle. In other embodiments, an extension system is provided on less than all mooring lines.

Figure 3:
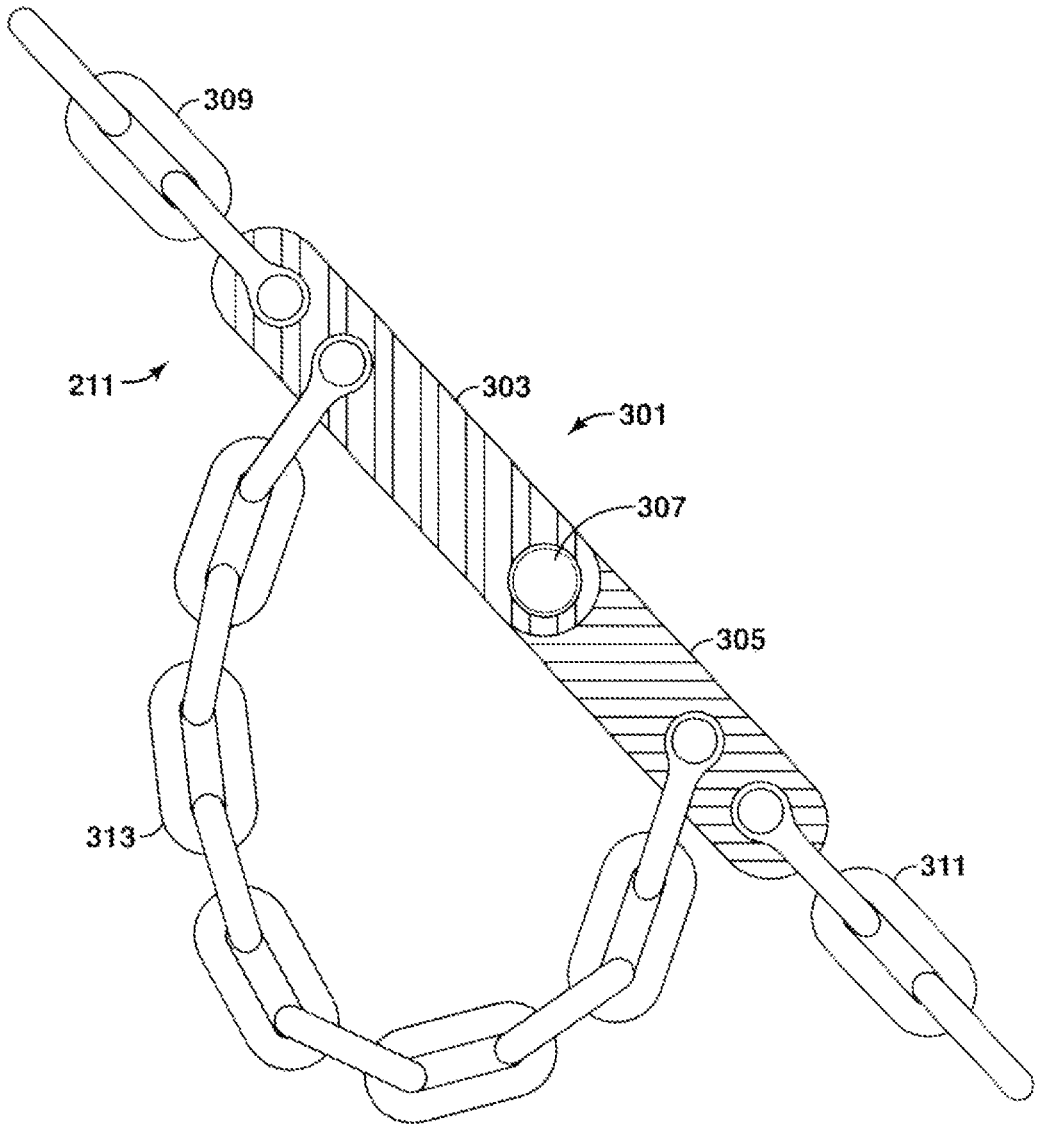
FIG. 3 is a top perspective view a mooring line extension system according to one embodiment of the present disclosure.

The advantages of extension system 211 will become apparent after considering FIG. 3, which depicts a more detailed view of one embodiment of the present disclosure. At the core of extension system 211 is separation device 301. Separation device 301 comprises of a first component 303 and a second component 305 which are mated together using a shear pin 307.

As generally depicted in FIG. 2, extension system 211 is positioned in-line along a given mooring line 205. As shown in the FIG. 3 embodiment, two separate mooring line sections are attached to separation device 301. More particularly, a first mooring line section 309 is connected to first component 303 and a second mooring line section 311 is connected to second component 305.

Extension system 211 also comprises an extension line 313 which has one end connected to the first component 303 and the other end connected to the second component 305. Depending on design objective and environmental conditions, the extension line can be a variety of lengths in order to achieve reasonable tension reduction compared to tension distribution in the neighboring mooring lines. In some embodiments, extension line 313 is 10 meters or less in length. In other embodiments, the extension line is longer than 10 meters. In the depicted embodiment, first mooring line section 309, second mooring line section 311 and extension line 313 are connected to separation device 301 with shackles. In other embodiments, the mooring line sections and extension lines may be attached to separation device 301 through other known techniques.

Figure 4:
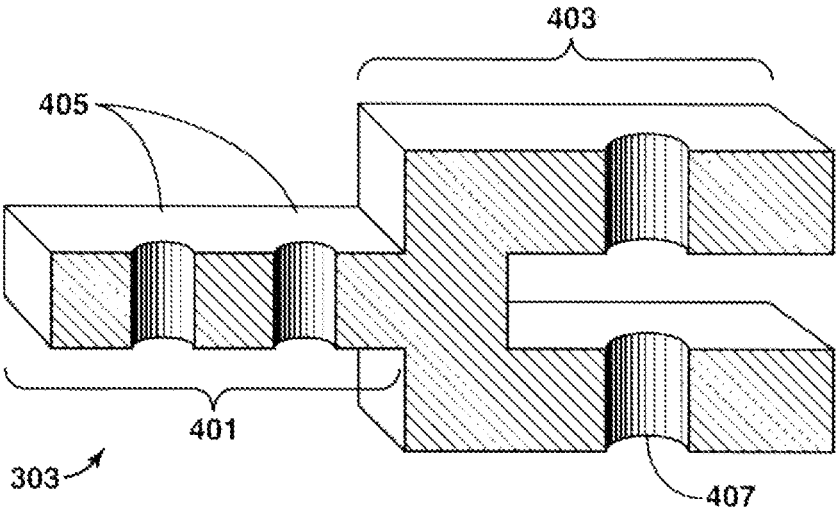
FIG. 4 is a perspective cross-sectional view of the first component depicted in FIG. 3.

A cross-sectional view of first component 303 is provided in FIG. 4. As depicted, first component 303 comprises a connection portion 401 and a mating portion 403. Connection portion 401 includes a plurality of holes or apertures 405 to allow connection to at least a mooring line section and/or extension line. Mating portion 403 includes shear pin holes 407. While first component 303 as depicted in FIG. 4 has a fork-like geometry having a two-prong mating portion 403, other geometries and shapes are contemplated and within the scope of the current invention. The holes or apertures may have different cross-sectional shapes such as, but not limited to, circular, square, triangular or rectangular.

Figure 5:
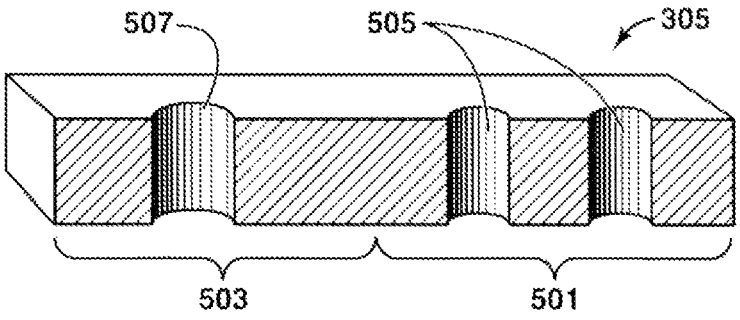
FIG. 5 is a perspective cross-sectional view of the second component depicted in FIG. 3.

A cross-sectional view of second component 305 is provided in FIG. 5. As depicted, second component 305 comprises a connection portion 501 and a mating portion 503. Connection portion 501 includes a plurality of holes or apertures 505 to allow connection to at least a mooring line section and/or extension line. Mating portion 503 includes a shear pin hole 507. As appreciated by those skilled in the art, the components comprising separation device 301 can be made of a variety of materials, such as, but not limited to, stainless steel. In some embodiments, the first line section, second line section, and/or extension line are chains. In other embodiments, the first line section, second line section, and extension line are comprised of synthetic material.

Figure 6:
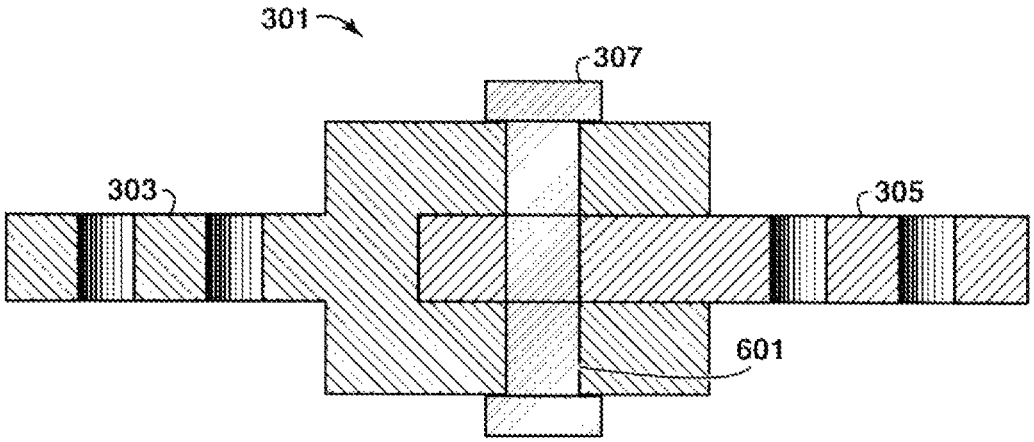
FIG. 6 is a cross-sectional side view of a separation device according to one embodiment of the present disclosure.

FIG. 6 provides a cross-sectional view of assembled separation device 301 according to one embodiment of the present disclosure. As illustrated, the mating portions of first component 303 and second component 305 are constructed and arranged to engage one another. When first component 303 and second component 305 are properly positioned, the shear pin holes 407, 507 of the respective components align to form a shear pin slot 601 through which shear pin 307 is positioned. Known techniques are utilized to hold shear pin 307 in place. In one embodiment, shear pin 307 has a head at one end and a threaded portion on the other end. After being inserted into the shear pin slot, a nut is threaded onto the threaded portion thereby holding the shear pin place. Other techniques may also been utilized.

As appreciated by those skilled in the art, shear pin 307 is designed to shear when subjected to a threshold force. The present invention utilizes a shear pin as a sacrificial part of the offshore mooring system. More specifically, the shear pin is designed to break prior to any extreme-load-driven failure of the mooring component under tension, i.e., the mooring line.

As previously discussed, one line within a mooring line bundle is typically subjected to a greater load as compared to other lines within the same bundle. In known systems, when the tension exceeds the threshold for that line, the mooring line will break which often leads to an increased tension on the other lines within the bundle.

The current disclosure demonstrates how to apply embodiments of the present invention to offshore floating oil/gas production platforms or other marine vessels as a part of a permanent mooring system. As appreciated by those skilled in the art, offshore floating structures often encounter situations where one or multiple of its mooring lines break due to either loss of its strength or unexpected extreme environmental loads. This may result from a variety of conditions, such as, but not limited to, corrosion, underpredicted metocean design condition, manufacturing defects of the mooring components.

In order to avoid complete failure of a mooring line, the extension system 211 of the present disclosure is designed to increase the total mooring line length by allowing shear pin 307 of separation device 301 to break when the extreme mooring line tension reaches the design break strength of the shear pin. The mooring line length is then allowed to extend depending upon the length of extension line 313. Due to characteristics of a mooring line in a catenary shape, it becomes slackened which will lead to a condition where the mooring line tension is redistributed with lower tension values.

With this load redistribution in the same mooring line and among the neighboring mooring lines, the most loaded line (or the line under highest failure risk) becomes relaxed and other neighboring mooring lines begin to share the extreme load. In contrast and as noted above, if a mooring line breaks rather than a line being relaxed, the neighboring lines should have higher tension which may lead to progressive additional mooring line failures. In addition, the extreme offset of the floating structure or vessel can be reduced as compared to the broken line case because the relaxed line still contributes to the mooring system.

Figure 7:
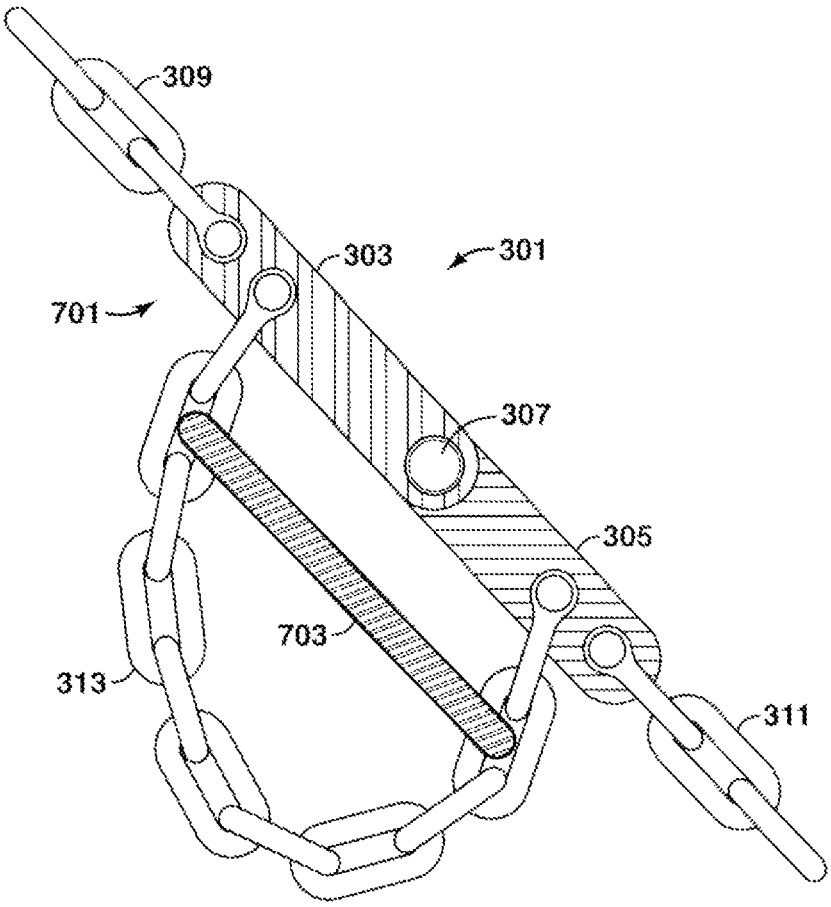
FIG. 7 is a top perspective view of a mooring line extension system according to another embodiment of the present disclosure.

In practice, the extension system may slightly increase the dynamic load along the mooring line due to sudden shearing of the shear pin. In some embodiments, a shock absorbing component is added to reduce the snatch load. One such embodiment is depicted in FIG. 7. The extension system depicted in FIG. 3 contains many of the components of the extension system 701 depicted in FIG. 7. Common reference numerals denote common components between the two extension systems. Extension system 701 also includes shock absorber 703 which is affixed to extension line 313 at two separate locations. In one embodiment, shock absorber 703 is made of a flexible, resilient material, such as, but not limited to, nylon rope or other synthetic materials. In some embodiments, shock absorber 703 has a relaxed (i.e., under little or no load) length less than the length of extension line 313. Such an arrangement reduces the snatch load experienced on extension line 313 when shear pin 307 is sheared thereby releasing first component 303 from second component 305.

In some embodiments, the range of the design break strength of the shear pin is based on the safety factors described in API (American Petroleum Institute) Recommended Practices. Presently, API RP recommends that permanent mooring designs meet the minimum required safety factors: 60% of MBS for the intact mooring condition and 80% of MBS for the one line damaged condition. In one embodiment, the proposed shear pin shall be designed to break before any mooring line tension reaches its Minimum Break Strength (MBS) in order to prevent the mooring line failure. In some embodiments, the shear pin is designed to break between 80-100% of MBS of the mooring line.

As an example of how embodiments of the present disclosure can prevent mooring line failure, Table 1 demonstrates that mooring loads can be significantly reduced by adding extra mooring line length through the invented method after the shear pin breaks.

TABLE 1

| Pretension Reduction at Nominal Position | | | Top Tension Reduction at 30 m Offset | | |
|---|---|---|---|---|---|
| Top chain increase m | Tension MT | Reduction % | Top chain increase m | Tension MT | Reduction % |
| 0 | 224 | 0% | 0 | 910 | 0% |
| 10 | 183 | 18% | 10 | 416 | 54% |
| 20 | 164 | 27% | 20 | 241 | 74% |

The table compares the top tension reduction in the mooring line for two simulated conditions: nominal position and 30 meter offset. The nominal condition represents a standard pretension in all lines and calm conditions, whereas the 30 m offset represents extreme tension on the line due to bad conditions, such as a hurricane. This is evident in the tension amounts with a 0 meter increase in mooring line where the tension is 224 MT for normal conditions compared to 910 MT for extreme load conditions.

The simulation found that an increase in the top chain length by 10 meters in the nominal position case results in an 18% reduction in mooring line tension, while an increase of 20 meters results in a 27% reduction. As demonstrated by Table 1, the results were more dramatic in the 30 meter offset condition. Specifically, a top chain increase of 10 meters results in a tension reduction of 54%. A 74% reduction resulted when the top chain was increased by 20 meters. This simulation confirms that the utilization of the extension system of the present disclosure would cause a dramatic reduction in mooring line tension, particularly in extreme tension conditions. As will be appreciated by those of ordinary skill after considering the current disclosure, the combination of the separation device and extension line reduces the likelihood that the mooring line will break while allowing the "separated" line to still assist other lines within a mooring line bundle as well as making it restorable to its intact condition through simple repair work.

Some exemplary functional features of one disclosed embodiment of the present disclosure include: (a) breaking a shear pin, (b) to relax the tension on a mooring by lengthening that mooring line under the load, (c) to redistribute the load in the same mooring bundle, and (d) to reduce the mooring stiffness so that the mooring system is more compliant in order to survive before the overload causes a mooring failure.

The extension system of the present disclosure may be integrated into any offshore mooring system in order to prevent extreme load driven failures. After the extreme event passes, the extension system can be easily replaced or repaired for future potential extreme events. In some embodiments, repairing the extension system only requires the insertion of a new shear pin to re-connect the first and second components of the separation device.

The following lettered paragraphs represent non-exclusive ways of describing embodiments of the present disclosure.

A. A mooring system for a marine vessel comprising: at least one mooring line, each of the at least one mooring lines having a first line section and a second line section; an extension device associated with the at least one mooring lines, the extension devices comprises a first component and a second component, the first component having a first shear pin hole, the second component having a second shear pin hole; a shear pin positioned within the first shear pin hole and the second shear pin hole thereby connecting the first component and the second component; and an extension line having a first end connected to the first component and a second end connected to the second component.

B. The system of paragraph A, wherein the extension line has a length of 10 meters or less.

C. The system of any preceding paragraph, wherein the mooring line has a minimum break strength, the shear pin is constructed and arranged to shear at a force of 80-100% of the minimum break strength.

D. The system of any preceding paragraph further comprising a shock absorber affixed at two separate locations along the extension line.

E. The system of paragraph D, wherein the shock absorber is made of a flexible material.

F. The system of paragraph D or E, wherein the shock absorber is comprised of nylon.

G. The system of paragraph D, E or F, wherein the extension line has a first length, the shock absorber has a second length when in a relaxed state, the first length is greater than the second length.

H. The system of any preceding paragraph, wherein the first line section, second line section, and extension line are chains.

I. The system of any preceding paragraph, wherein the first component comprises a first hole and a second hole, the first line section is connected to the first component at the first hole, the extension line is connected to the first component at the second hole.

J. The system of any preceding paragraph, wherein the first line section is connected to the marine vessel.

K. The system of any preceding paragraph, wherein the first component is constructed and arranged to mate with the second portion.

L. The system of paragraph K, wherein the first shear pin hole and the second shear pin hole align when the first component is mated with the second component to define a shear pin slot, the shear pin is disposed within the shear pin slot.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. A mooring system for a marine vessel comprising:

at least one mooring line, the at least one mooring line having a first line section and a second line section; and an extension device, the extension device comprises:

a first component, the first component attached to the first line section and having a first shear pin hole, a second component, the second component attached to the second line section and having a second shear pin hole, a shear pin positioned within the first shear pin hole and the second shear pin hole thereby connecting the first component and the second component, and an extension line having a first end connected to the first component and a second end connected to the second component.

2. The system of claim 1, wherein the extension line has a length of 10 meters or less.

3. The system of claim 1, wherein the at least one mooring line has a minimum break strength, the shear pin is constructed and arranged to shear at a force of 80-100% of the minimum break strength.

4. The system of claim 1 further comprising a shock absorber affixed at two separate locations along the extension line.

5. The system of claim 4, wherein the shock absorber is made of a flexible material.

6. The system of claim 5, wherein the shock absorber is comprised of nylon.

7. The system of claim 4, wherein the extension line has a first length, the shock absorber has a second length when in a relaxed state, the first length is greater than the second length.

8. The system of claim 1, wherein the first line section, the second line section, and the extension line are chains.

9. The system of claim 1, wherein the first component comprises a first hole and a second hole, the first line section is connected to the first component at the first hole, the extension line is connected to the first component at the second hole.

10. The system of claim 9, wherein the first line section is connected to the marine vessel.

11. The system of claim 1, wherein the first component mates with the second component.

12. The system of claim 11, wherein the first shear pin hole and the second shear pin hole align when the first component is mated with the second component to define a shear pin slot, the shear pin is disposed within the shear pin slot.

* * * * *